US008584975B2

(12) United States Patent
Li et al.

(10) Patent No.: US 8,584,975 B2
(45) Date of Patent: Nov. 19, 2013

(54) BALL MILLING PROCESS FOR PREPARING HARD ALLOY MIXTURE

(75) Inventors: Yanjun Li, Jiangxi (CN); Juanmei Zhong, Jiangxi (CN); Zhifang Liu, Jiangxi (CN); Song Hu, Jiangxi (CN)

(73) Assignee: Jiangxi Rare Earth and Rare Metals Tungsten Group Corporation, Jiangxi (CN)

( * ) Notice: Subject to any disclaimer, the term of this patent is extended or adjusted under 35 U.S.C. 154(b) by 351 days.

(21) Appl. No.: 13/144,699

(22) PCT Filed: Dec. 30, 2009

(86) PCT No.: PCT/CN2009/076228

§ 371 (c)(1), (2), (4) Date: Aug. 3, 2011

(87) PCT Pub. No.: WO2010/081377

PCT Pub. Date: Jul. 22, 2010

(65) Prior Publication Data

US 2012/0018547 A1 Jan. 26, 2012

(30) Foreign Application Priority Data

Jan. 16, 2009 (CN) ..... 2009 1 0077140

(51) Int. Cl.
*B02C 25/00* (2006.01)
*B02C 17/14* (2006.01)

(52) U.S. Cl.
USPC ..... 241/30; 241/184

(58) Field of Classification Search
USPC ..... 241/30, 184
See application file for complete search history.

(56) References Cited

U.S. PATENT DOCUMENTS

| | | | | |
|---|---|---|---|---|
| 2,558,327 | A * | 6/1951 | Weston | 241/184 |
| 3,008,656 | A * | 11/1961 | Weston | 241/30 |
| 2009/0020638 | A1 * | 1/2009 | Becker et al. | 241/291 |

FOREIGN PATENT DOCUMENTS

| | | | |
|---|---|---|---|
| CN | 1530456 | A | 9/2004 |
| CN | 1775973 | A | 5/2006 |
| CN | 101462163 | A | 6/2009 |

* cited by examiner

*Primary Examiner* — Faye Francis
(74) *Attorney, Agent, or Firm* — Hammer & Associates, P.C.

(57) ABSTRACT

A ball milling process for preparing hard alloy mixture, characterized by utilizing a process of stirring ball milling, in which balls of hard alloy with diameters of 4 to 6 mm are used, the positive and negative deviation of the diameters of the alloy balls is less than or equal to 0.1 mm; tungsten carbide powders with particle sizes of 0.3 to 0.8 μm and cobalt powders are used; ethyl alcohol is used as a grinding medium, while paraffin wax is used as a forming agent. This process of ball milling has advantages of high efficiency, low energy consumption, ease of mass production, etc. and can be widely used in the preparation of hard alloy mixture.

8 Claims, No Drawings

BALL MILLING PROCESS FOR PREPARING HARD ALLOY MIXTURE

TECHNICAL FIELD

The present invention relates to a ball milling process for preparing hard alloy mixture, in particular to a stirring ball milling process for preparing ultra-fine WC—Co hard alloy mixture.

As used herein, the term "ultra-fine tungsten carbide" refers to tungsten carbide powders having particle sizes between 0.3 and 0.8 μm, and the term "ultra-fine cobalt powders" refers to cobalt powders having particle sizes less than 1.0 μm.

PRIOR ART

The preparation of hard alloy mixture is one of the most important processes in the production of hard alloys, the aim of which is to make various carbides and powders for bonding metals up into a homogeneous mixture with a given composition and a given particle size; the quality of this process is an important aspect determining the quality of the hard alloy.

Currently, a tilting-type rolling ball milling process is usually employed for producing an ultra-fine hard alloy mixture. This process has such disadvantages as much noise, large energy consumption, and low efficiency.

SUMMARY OF THE INVENTION

The object of the present invention is to provide a ball milling process for preparing hard alloy mixture with less noise, low energy consumption and high efficiency.

To achieve the above purpose, the present invention provides a ball milling process for preparing hard alloy mixture, characterized in that there is utilized a process of stirring ball milling, in which balls of hard alloy with diameters of 4 to 6 mm are used, the positive and negative deviation of the diameters of the alloy balls is less than or equal to 0.1 mm; tungsten carbide powders with particle sizes of 0.3 to 0.8 μm and cobalt powders are used; ethyl alcohol is used as a grinding medium, while paraffin wax is used as a forming agent.

Preferably, the rotating speed of the mixing arm is 100 to 135 rpm, and the ball milling time is 6 to 8 h.

Preferably, the amount of ethyl alcohol added is 500 to 800 ml/Kg.

Preferably, the amount of paraffin wax added is 1.5 wt % to 2.5 wt %.

Preferably, the ball-powder ratio of the balls of hard alloy to the tungsten carbide powders and cobalt powders is 3:1.

In particular, a process of stirring ball milling is utilized for preparing the ultra-fine hard alloy mixture according to the present invention, wherein ultra-fine tungsten carbide powders and ultra-fine cobalt powders are used; balls of hard alloy with diameters of 4 to 6 mm and a cobalt content of 8 wt % are used, the positive and negative deviation of the diameters of the alloy balls being less than or equal to 0.1 mm; ethyl alcohol is used as a grinding medium, added in amount of 600 to 800 ml/Kg; paraffin wax is added in amount of 1.5 wt % to 2.5 wt % as a forming agent; the ball-powder ratio is 3:1; the rotating speed of the mixing arm is 100 to 135 rpm; and the ball milling time is 6 to 8 hours.

As the diameters (Φ) of the alloy balls are 4 to 6 mm, which is relatively small, the specific surface area of the grinding balls is lager than that of conventional grinding rods, and as the rotating speed of the mixer is increased while milling, the relative movement between the alloy balls is intensified, thereby improving the grinding effect of the alloy balls on the powders. The milling time for the mixture is greatly reduced, and the equipments are operated with little noises.

DETAILED DESCRIPTION

EXAMPLE 1

The ultra-fine (particle size is 0.3 μm) tungsten carbide (WC) powders and ultra-fine (particle size <1.0 μm) cobalt powders are used, the powder composition is 93 wt % WC+6 wt % Co+1 wt % ($Cr_3C_2$+VC); balls of hard alloy with a diameter of Φ4 mm are used, the diameters of the positive and negative alloy ball deviation is less than or equal to 0.1 mm; ethyl alcohol is used as a grinding medium, and the amount added is 750 ml/Kg; paraffin wax of 2.5 wt % is added as a forming agent; the ball-powder ratio is 3:1; the rotating speed of the mixing arm is 135 rpm; and the ball milling time is 8 hours.

EXAMPLE 2

The ultra-fine (particle size is 0.3 μm) tungsten carbide (WC) powders and ultra-fine (particle size <1.0 μm) cobalt powders are used, the powder composition is 91 wt % WC+8 wt % Co+1 wt % ($Cr_3C_2$+VC); balls of hard alloy with a diameter of Φ4 mm are used, the diameters of the positive and negative alloy ball deviation is less than or equal to 0.1 mm; ethyl alcohol is used as a grinding medium, and the amount added is 800 ml/Kg; paraffin wax of 2.5 wt % is added as a forming agent; the ball-powder ratio is 3:1; the rotating speed of the mixing arm is 130 rpm; and the ball milling time is 8 hours.

EXAMPLE 3

The ultra-fine (particle size is 0.6 μm) tungsten carbide (WC) powders and ultra-fine (particle size <1.0 μm) cobalt powders are used, the powder composition is 93.5 wt % WC+6 wt % Co+0.5 wt % ($Cr_3C_2$+VC); balls of hard alloy with a diameter of Φ5 mm are used, the diameters of the positive and negative alloy ball deviation is less than or equal to 0.1 mm; ethyl alcohol is used as a grinding medium, and the amount added is 700 ml/Kg; paraffin wax of 2.5 wt % is added as a forming agent; the ball-powder ratio is 3:1; the rotating speed of the mixing arm is 130 rpm; and the ball milling time is 7.0 hours.

EXAMPLE 4

The ultra-fine (particle size is 0.8 μm) tungsten carbide (WC) powders and ultra-fine (particle size <1.0 μm) cobalt powders are used, the powder composition is 89.5 wt % WC+10 wt % Co+0.5 wt % ($Cr_3C_2$+VC); balls of hard alloy with a diameter of Φ6 mm are used, the diameters of the positive and negative alloy ball deviation is less than or equal to 0.1 mm; ethyl alcohol is used as a grinding medium, and the amount added is 650 ml/Kg; paraffin wax of 2.0 wt % is added as a forming agent; the ball-powder ratio is 3:1; the rotating speed of the mixing arm is 110 rpm; and the ball milling time is 6 hours.

EXAMPLE 5

The ultra-fine (particle size is 0.8 μm) tungsten carbide (WC) powders and ultra-fine (particle size <1.0 μm) cobalt powders are used, the powder composition is 91.5 wt %

WC+8 wt % Co+0.5 wt % ($Cr_3C_2$+VC); balls of hard alloy with a diameter of Φ5 mm are used, the diameters of the positive and negative alloy ball deviation is less than or equal to 0.1 mm; ethyl alcohol is used as a grinding medium, and the amount added is 600 ml/Kg; paraffin wax of 2.0 wt % is added as a forming agent; the ball-powder ratio is 3:1; the rotating speed of the mixing arm is 100 rpm; and the ball milling time is 6 hours.

While the present invention has been illustrated by way of several examples, it is to be understood that modifications, variations, improvements and/or replacements in one way or another can be made by those skilled in the art according to the present disclosures, which are all within the scope of the appended claims.

The invention claimed is:

1. A ball milling process for preparing hard alloy mixed materials, characterized in that there is utilized a process of stirring ball milling, in which balls of hard alloy with diameters of 4 to 6 mm are used, the positive and negative deviations of the diameters of the alloy balls are less than or equal to 0.1 mm; tungsten carbide powders with grain sizes of 0.3 to 0.8 μm and ultra-fine cobalt powders with grain sizes less than 1.0 μm are used; ethyl alcohol is used as a grinding medium, and paraffin wax is used as a forming agent; the ball-powder ratio of the balls of hard alloy to the tungsten carbide powders and cobalt powders is 3:1; the rotating speed of the mixing arm is 100 to 135 rpm, and the ball milling time is 6 to 8 hours.

2. The ball milling process for preparing hard alloy mixed materials according to claim 1, characterized in that the amount of ethyl alcohol added is 500 to 800 ml/Kg.

3. The ball milling process for preparing hard alloy mixed materials according to claim 1, characterized in that the amount of paraffin wax added is 1.5 wt % to 2.5 wt %.

4. The ball milling process for preparing hard alloy mixed materials according to claim 1, characterized in that the grain size of tungsten carbide powders is 0.3 μm, the powder composition is 93 wt % WC+6 wt % Co+1 wt % ($Cr_3C_2$+VC); balls of hard alloy with a diameter of 4 mm are used, the amount of ethyl alcohol added is 750 ml/Kg; paraffin wax added is 2.5 wt %; the rotating speed of the mixing arm is 135 rpm; and the ball milling time is 8 hours.

5. The ball milling process for preparing hard alloy mixed materials according to claim 1, characterized in that the grain size of tungsten carbide powders is 0.3 μm, the powder composition is 91 wt % WC+8 wt % Co+1 wt % ($Cr_3C_2$+VC); balls of hard alloy with a diameter of 4 mm are used, the amount of ethyl alcohol added is 800 ml/Kg; paraffin wax added is 2.5 wt %; the rotating speed of the mixing arm is 130 rpm; and the ball milling time is 8 hours.

6. The ball milling process for preparing hard alloy mixed materials according to claim 1, characterized in that the grain size of tungsten carbide powders is 0.6 μm, the powder composition is 93.5 wt % WC+6 wt % Co+0.5 wt % ($Cr_3C_2$+VC); balls of hard alloy with a diameter of 5 mm are used, the amount of ethyl alcohol added is 700 ml/Kg; paraffin wax added is 2.5 wt %; the rotating speed of the mixing arm is 130 rpm; and the ball milling time is 7 hours.

7. The ball milling process for preparing hard alloy mixed materials according to claim 1, characterized in that the grain size of tungsten carbide powders is 0.8 μm, the powder composition is 89.5 wt % WC+10 wt % Co+0.5 wt % ($Cr_3C_2$+VC); balls of hard alloy with a diameter of 6 mm are used, the amount of ethyl alcohol added is 650 ml/Kg; paraffin wax added is 2.0 wt %; the rotating speed of the mixing arm is 110 rpm; and the ball milling time is 6 hours.

8. The ball milling process for preparing hard alloy mixed materials according to claim 1, characterized in that the grain size of tungsten carbide powders is 0.8 μm, the powder composition is 91.5 wt % WC+8 wt % Co+0.5 wt % ($Cr_3C_2$+VC); balls of hard alloy with a diameter of 5 mm are used, the amount of ethyl alcohol added is 600 ml/Kg; paraffin wax added is 2.0 wt %; the rotating speed of the mixing arm is 100 rpm; and the ball milling time is 6 hours.

* * * * *